US009478903B2

(12) United States Patent
Zhang et al.

(10) Patent No.: US 9,478,903 B2
(45) Date of Patent: Oct. 25, 2016

(54) CONNECTING TERMINAL

(71) Applicant: Tyco Electronics (Shanghai) Co. Ltd., Shanghai (CN)

(72) Inventors: Weidong Zhang, Shanghai (CN); Sean Wang, Shanghai (CN); Jun Chang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 15 days.

(21) Appl. No.: 14/497,866

(22) Filed: Sep. 26, 2014

(65) Prior Publication Data

US 2015/0093929 A1 Apr. 2, 2015

(30) Foreign Application Priority Data

Sep. 27, 2013 (CN) ..... 2013 2 0604154 U

(51) Int. Cl.

| | |
|---|---|
| ***H01R 13/627*** | (2006.01) |
| ***H01R 4/18*** | (2006.01) |
| ***H01R 13/11*** | (2006.01) |
| ***H01R 13/41*** | (2006.01) |
| *H01R 43/16* | (2006.01) |

(52) U.S. Cl.

CPC ..... *H01R 13/627* (2013.01); *H01R 4/185* (2013.01); *H01R 13/113* (2013.01); *H01R 13/41* (2013.01); *H01R 43/16* (2013.01)

(58) Field of Classification Search

CPC ..... H01R 13/627

See application file for complete search history.

(56) References Cited

U.S. PATENT DOCUMENTS

| | | | | |
|---|---|---|---|---|
| 6,024,612 | A * | 2/2000 | Myer | H01R 13/113 439/744 |
| 6,062,918 | A * | 5/2000 | Myer | H01R 13/187 439/833 |
| 7,294,027 | B1 * | 11/2007 | Tyler | H01R 13/187 439/845 |
| 2005/0101198 | A1 * | 5/2005 | Maeda | H01R 13/11 439/852 |
| 2005/0260897 | A1 * | 11/2005 | Nimura | H01R 13/113 439/856 |
| 2015/0214658 | A1 * | 7/2015 | Nishiyama | H01R 24/76 439/357 |

* cited by examiner

*Primary Examiner* — Briggitte R Hammond
(74) *Attorney, Agent, or Firm* — Barley Snyder

(57) ABSTRACT

A connecting terminal is disclosed having a wire connection portion with at least one pair of side arms, and an abutting portion attached at a second end to the wire connection portion. The Abutting portion includes at least one mating terminal receiving chamber and a locking structure. The locking structure includes a locking surface facing the wire connection portion and extending perpendicularly to an insertion direction of the connecting terminal, a first locking surface formed on an upper side of the abutting portion and a second locking surface formed on a lower side of the second end of the abutting portion.

22 Claims, 1 Drawing Sheet

CONNECTING TERMINAL

CROSS-REFERENCE TO RELATED APPLICATIONS

This application claims the benefit of the filing date under 35 U.S.C. §119(a)-(d) of Chinese Patent Application No. 2013-20604154.2, filed Sep. 27, 2013.

FIELD OF THE INVENTION

The invention relates to an electrical connecting terminal, and more specifically to an electrical connecting terminal having a locking structure.

BACKGROUND

Connecting terminals include male and female terminals and are usually mounted and used in a connector housing. To maintain a position of the connecting terminal in the connector housing, the connecting terminal and the connector housing are provided with a locking structure to prevent the connecting terminal from disengaging from the connector housing. However, current locking structures do not adequately provide stable connections between the connecting terminals and the connector housing. Therefore there is a need for a locking structure that provides stable connections between connecting terminals and the connector housing.

SUMMARY

A connecting terminal has a wire connection portion with at least one pair of side arms, and an abutting portion attached at a second end to the wire connection portion. The abutting portion includes at least one mating terminal receiving chamber and a locking structure. The locking structure includes a locking surface facing the wire connection portion and extending perpendicularly to an insertion direction of the connecting terminal, a first locking surface formed on an upper side of the abutting portion and a second locking surface formed on a lower side of the second end of the abutting portion.

BRIEF DESCRIPTION OF THE DRAWINGS

The invention will now be described by way of example, with reference to the accompanying figures, of which.

DETAILED DESCRIPTION OF THE EMBODIMENT(S)

Figure 1:
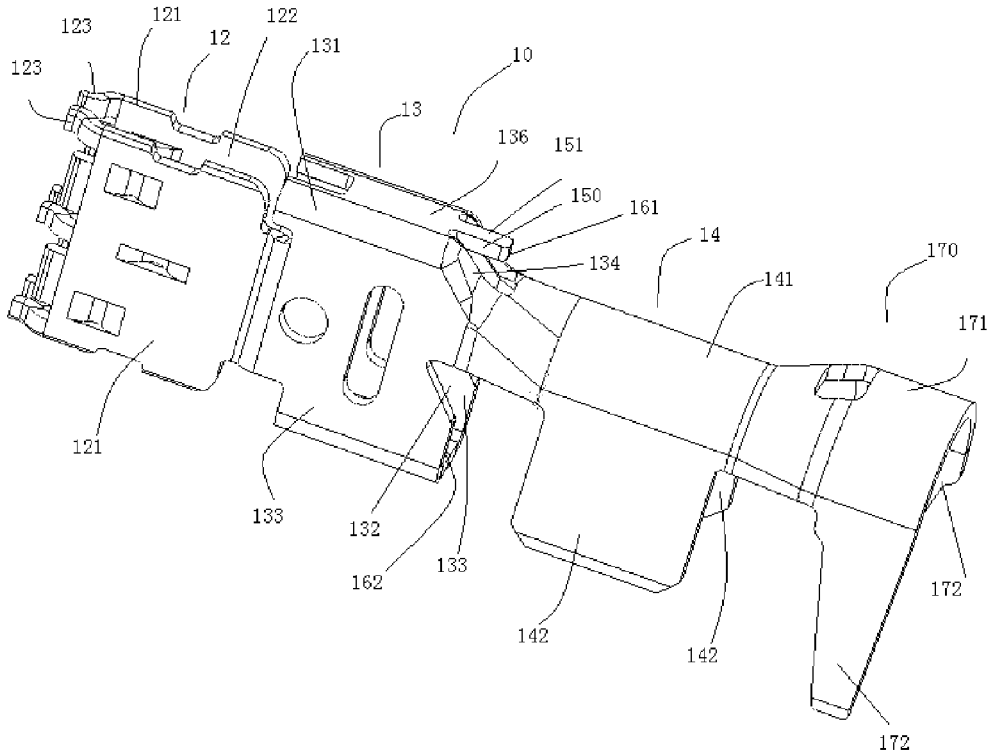
FIG. 1 is a perspective view of a connecting terminal according to the invention.
Figure 2:
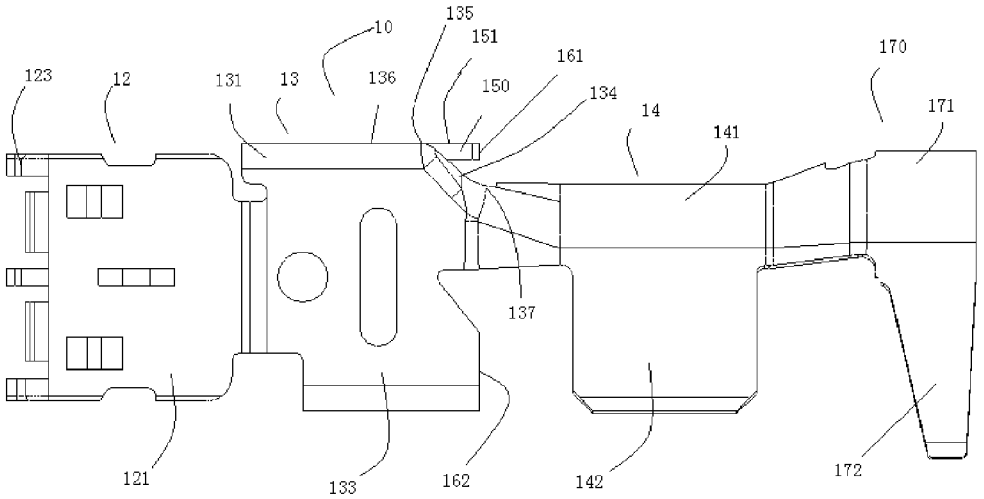
FIG. 2 is a front view of the connecting terminal shown in FIG. 1.

As shown in FIGS. 1 and 2, a connecting terminal 10 comprises an insertion portion 12, a abutting portion 13 and a wire connection portion 14. Both ends of the abutting portion 13 are respectively connected to the insertion portion 12 and the wire connection portion 14. The insertion portion 12 and the wire connection portion 14 respectively extend from both ends of the abutting portion 13 in opposite directions. In an embodiment, the insertion portion 12, the abutting portion 13 and the wire connection portion 14 of the connecting terminal 10 are integrally formed. For example, the connecting terminal 10 is formed by stamping and bending a sheet material.

The insertion portion 12 comprises two opposing insertion contacts 121. A mating terminal receiving space 122 is provided between the two insertion contacts 121 and receives an inserted mating terminal between the two opposing insertion contacts 121. One end of the insertion contacts 121 are connected to the abutting portion 12 and the other end thereof is provided with a plurality of elastic tabs 123. The elastic tabs 123 on the two insertion contacts 121 oppose each other to form a clamping element. When a mating terminal is inserted into the insertion portion 12 of the connecting terminal 10, the opposing elastic tabs 123 are deflected away from each other, generating a clamping force used to grasp and hold the inserted mating terminal The abutting portion 13 comprises a body 131 and a mating terminal receiving chamber 132 disposed in the body 131. An first end (the left end as shown in FIG. 2) of the body 131 in the insertion direction is connected to the two insertion contacts 121. The mating terminal receiving chamber 132 is connected with the mating terminal receiving space 122 between the insertion contacts 121 and also receives the mating terminal In an exemplary embodiment, the mating terminal receiving chamber 132 is formed by bending two bent arms 133 on the body 131.

A second end (the right end in FIG. 2) of the body 131 in the insertion direction is connected to the wire connection portion 14. In the exemplary embodiment shown in FIG. 2, the wire connection portion 14 is connected to a middle portion of the second end of the body 131 in an up-down direction, perpendicular to a longitudinal axis of the connecting terminal 10.

The second end of the body 131 is further provided with a locking structure. In an embodiment, the locking structure comprises a locking surface disposed rearward perpendicular to the insertion direction. The locking surface comprises a first locking surface 161 and a second locking surface 162 respectively disposed on an upper side and a lower side of the wire connection portion 14. In an embodiment, the first locking surface 161 and the second locking surface 162 are disposed on the same plane, perpendicular to the insertion direction.

When the connecting terminal 10 is inserted and mounted in a corresponding connector housing, the first locking surface 161 and the second locking surface 162 lock the connecting terminal 10 from an upper side and a lower side of the connecting terminal 10 respectively so as to increase a retaining force of the connecting terminal 10 in the connector housing. The retaining force prevents the connecting terminal 10 from disengaging from the connector housing.

In an embodiment, a protrusion 150 is positioned at an upper portion of the second end of the body 131 and extends towards the wire connection portion 14 from an upper surface 136 of the abutting portion 13. The first locking surface 161 at the upper portion of the second end of the body 131 is provided at a second end facing surface of the protrusion 150. The protrusion 150 is a unitary member extending from abutting portion 13 of the connecting terminal 10. For example, the protrusion 150 and the remaining portions of the connecting terminal 10 may be formed by stamping and bending. The second locking surface 162 is a second end facing surface of the bent arms 133 forming the mating terminal receiving chamber 132.

In an embodiment shown in FIG. 2, a ramp 134 is positioned on an upper portion of the second end of the body 131. A first ramp end 135 of the ramp 134 extends downward from the upper surface 136 of the abutting portion 13. A second ramp end 137 of the ramp 134 is connected to a connection body 141. Through the connection of the ramp 134, an upper surface of the connection body 141 is lower than the upper surface 136 of the body 131 and abutting portion 13. The protrusion 150 extends to the second end from the first ramp end 135 of the ramp 134. The second ramp end 137 of the ramp is disposed below the protrusion 150. The upper surface 151 of the protrusion 150 is flush with the upper surface 136 of the abutting portion 13. The width of the protrusion 150 is smaller than the width of the abutting portion 13.

The wire connection portion 14 comprises a connection body 141 and a pair of side arms 142. The connection body 141 extend from the second ramp end 137 of the ramp 134. The pair of side arms 142 are positioned opposite to each other and extend downward from the connection body 141. The side arms 142 are used for contacting an inserted wire to form an electrical connection and to fix the wire to the connecting terminal 10.

The wire connection portion 14 further includes a fixing member 170. The fixing member 170 comprises a fixing body 171 and at least one pair of fixing arms 172. The fixing arms 172 are bent and connected to the fixing body 171. The fixing arms 172 grasp and hold an insulated wire to the fixing body 171, which enhances the stability of the lead wire and prevents disengagement between the lead wire and the side arms 142.

The connecting terminal 10 may be inserted into and mounted in the connector housing. In an exemplary embodiment, the connector housing having the connecting terminal 10 inserted may include an anti-retreat structure mating with a locking structure. After the connecting terminal 10 is inserted into the connector housing, the locking structure may abut against the mating anti-retreat structure on the connector housing, which increases the stability and degree of firmness of the connection between the two and prevent the connecting terminal 10 from retreating out of the connector housing.

The connecting terminal 10 in the above described embodiments, is connectable to the mating connecting terminal and then locked with a locking structure to achieve a more stable connection than connection of a conventional connecting terminal only having an insertion portion 12. Furthermore, since the first locking surface 161 and the second locking surface 162 are respectively disposed on an upper side and a lower side of the abutting portion 13, the connecting terminal 10 is more stably connected to the mating connecting terminal and unlikely to be disengaged. Additionally, since the first locking surface 161 is formed from a unitary piece of material, the invention is more convenient to produce and structurally simpler than the multi-component conventional designs.

For the sake of convenience in describing the invention, the terms "front", "rear", "left", "right", "upper", "lower", "front end", "rear end", "left end", "right end", "upper portion" and "lower portion" and the like are used herein as relative concepts with reference to FIG. 2 while the connecting terminal is in use.

Embodiments of the invention are only illustrative of the invention and are not intended to limit the scope of the claims. Other substantive equivalent substitutes that can be envisaged by those skilled in the art all fall within the protection scope of the invention.

What is claimed is:

1. A connecting terminal comprising:

a wire connection portion having at least one pair of side arms; and an abutting portion attached at a first end to the wire connection portion and having at least one mating terminal receiving chamber, a locking structure having a locking surface facing the wire connection portion and extending perpendicularly to a longitudinal axis of the connecting terminal, and having a first locking surface formed on an upper side of the abutting portion and a second locking surface formed on a lower side of the first end of the abutting portion.

2. The connecting terminal according to claim 1, further comprising a protrusion on an upper portion of the first end of the abutting portion.

3. The connecting terminal according to claim 2, wherein the protrusion extends from the first end of the abutting portion towards the wire connection portion.

4. The connecting terminal according to claim 3, wherein the first locking surface of the protrusion faces the first end of the abutting portion.

5. The connecting terminal according to claim 4, wherein the protrusion extends from an upper surface of the first end.

6. The connecting terminal according to claim 5, further comprising a ramp positioned at the first end of the abutting portion.

7. The connecting terminal according to claim 6, wherein the ramp extends from an upper surface of the abutting portion downwardly toward the wire connection portion.

8. The connecting terminal according to claim 7, wherein a portion of the ramp is disposed below the protrusion.

9. The connecting terminal according to claim 4, wherein the first end facing surface of the protrusion is flush with the first end of the abutting portion in a direction perpendicular to the longitundinal axis.

10. The connecting terminal according to claim 2, wherein an upper surface of the protrusion is flush with the upper surface of the abutting portion.

11. The connecting terminal according to claim 2, wherein the protrusion is a stamped member.

12. The connecting terminal according to claim 2, wherein the protrusion is formed continuously with the connecting terminal from a single stamped member.

13. The connecting terminal according to claim 2, wherein the connecting terminal is formed from a single stamped member.

14. The connecting terminal according to claim 7, wherein the wire connection portion includes a connection body that extends from a lower end of the ramp.

15. The connecting terminal according to claim 1, wherein the abutting portion further includes a body having the mating terminal receiving chamber disposed therein, and the second locking surface positioned on the first end facing surface thereof.

16. The connecting terminal according to claim 1, wherein the connecting terminal further comprises an insertion portion connected to the abutting portion.

17. The connecting terminal according to claim 16, wherein, the insertion portion and the wire connection portion are respectively disposed on opposite ends of the abutting portion.

18. The connecting terminal according to claim 16, wherein the insertion portion has two insertion contacts positioned opposite each other with a mating terminal receiving space positioned therebetween.

19. The connecting terminal according to claim 18, wherein the mating terminal receiving space is connected continuously with the receiving chamber.

20. The connecting terminal according to claim 18, wherein the insertion contacts each have a free end positioned opposite the abutting portion, and a plurality of spring tabs positioned on the free end.

21. The connecting terminal according to claim 1, wherein the wire connection portion further includes a fixing member having a fixing body and at least one pair of fixing wings.

22. The connecting terminal according to claim 1, wherein the first locking surface and the second locking surface are disposed on a same plane perpendicular to the longitudinal axis.

* * * * *